US005290653A

United States Patent [19]

Pearlstine

[11] Patent Number: 5,290,653

[45] Date of Patent: Mar. 1, 1994

[54] BLOCK COPOLYMER AMINE SALTS AS CHARGE DIRECTORS FOR NEGATIVE ELECTROSTATIC LIQUID DEVELOPER

[75] Inventor: Kathryn A. Pearlstine, Wilmington, Del.

[73] Assignee: E. I. Du Pont de Nemours and Company, Wilmington, Del.

[21] Appl. No.: 886,312

[22] Filed: May 21, 1992

[51] Int. Cl.[5] ..... G03G 9/12

[52] U.S. Cl. ..... 430/114; 430/115; 430/119; 430/137

[58] Field of Search ..... 430/114, 115, 119, 137

[56] References Cited

U.S. PATENT DOCUMENTS

| | | | |
|---|---|---|---|
| 4,957,844 | 9/1990 | Page | 430/115 |
| 5,035,972 | 7/1991 | El-Sayed et al. | 430/114 |
| 5,106,717 | 4/1992 | Houle et al. | 430/114 |
| 5,130,221 | 7/1992 | El-Sayed et al. | 430/114 |

*Primary Examiner*—John Kight, III
*Assistant Examiner*—Shelley A. Dodson

[57] ABSTRACT

A negative-working electrostatic liquid developer consists essentially of a nonpolar liquid having Kauributanol value less than 30; thermoplastic resin particles having an average particle size by area of less than 10 μm; a salt of an AB diblock copolymer charge director compound as defined; and optionally a colorant and charge adjuvant; and process of making same.

16 Claims, No Drawings

BLOCK COPOLYMER AMINE SALTS AS CHARGE DIRECTORS FOR NEGATIVE ELECTROSTATIC LIQUID DEVELOPER

DESCRIPTION

1. Technical Field

This invention relates to electrostatic liquid developers. More particularly this invention relates to negative-working electrostatic liquid developers containing block copolymer amine salts as charge directors.

2. Background Art

It is known that a latent electrostatic image can be developed with liquid electrostatic toners (known in the art as "liquid toners" or "liquid developers"), which comprise thermoplastic resin toner particles dispersed in a carrier liquid, generally an insulating nonpolar liquid having a high volume resistivity in excess of $10^9$ ohm centimeters, a low dielectric constant below 3.0, and a high vapor pressure. Generally a suitable colorant such as a dye or pigment is present. The toner particles are less than 10 μm average by area size.

A latent electrostatic image may be produced by providing a photoconductive layer with a uniform electrostatic charge and subsequently discharging the electrostatic charge by exposing it to a modulated beam of radiant energy. Other methods are known for forming latent electrostatic images. After the latent electrostatic image has been formed, the image is developed by the liquid toner and the image may subsequently be transferred to a carrier sheet.

Since the formation of proper images depends on the differences of the charge between the liquid developer and the latent electrostatic image to be developed, it has been found desirable to add a charge director compound and preferably adjuvants, e.g., polyhydroxy compounds, aminoalcohols, polybutylene succinimide, metallic soaps, aromatic hydrocarbons, etc. to the liquid toner. Such liquid developers provide images of good resolution, but it has been found that charging and image quality are particularly pigment dependent. Some formulations suffer from poor image quality manifested by low resolution, poor solid area coverage, and/or image squash. Commercially available charge directors for toners often are by-products of the oil industry or decomposition residues of natural substances. These compounds are impure and the product composition is unreliable.

In order to overcome such problems much research effort has been expended to develop new type charge directors and/or charging adjuvant for electrostatic liquid toners.

Quaternized AB diblock copolymer charge directors are disclosed in U.S. Pat. No. 5,035,972. Although these charge directors were found to have good charging characteristics, it was found that the degree of quaternization had to be limited to insure complete reaction of the quaternization agents because the unreacted compounds are carcinogenic. This is disadvantageous because the higher the degree of quaternization, the higher the degree of charge obtained with the charge director.

It has been found that the above disadvantages can be overcome and improved developers prepared containing a dispersant nonpolar liquid, a thermoplastic resin, a charge director compound of the invention, and preferably a colorant and an adjuvant. The improved electrostatic liquid developer charged with the charge director compound of the invention, when used to develop an electrostatic image, results in image quality, squash, and solid area coverage comparable to other known charge directors with the additional advantage that, for a given liquid developer, the charge director structure can be controlled to optimize liquid developer performance.

DISCLOSURE OF THE INVENTION

In accordance with this invention there is provided an improved negative-working electrostatic liquid developer consisting essentially of (A) a nonpolar liquid having a Kauri-butanol value of less than 30;

(B) thermoplastic resin particles having an average by area particle size of less than 10 μm; and (C) a salt of an AB diblock copolymer charge director substantially soluble in component (A); wherein the B block is a polymer substantially soluble in component (A) having a number average molecular weight range of 2,000 to 50,000, and the A block is a trialkyl amino polymer having a number average molecular weight range of 200 to 10,000; wherein the number average degree of polymerization (DP) ratio of the B block to the A block being in the range of 10:2 to 100:20; and wherein the salt is formed by neutralizing the AB diblock copolymer with an acid.

In accordance with an embodiment of this invention there is provided a process for preparing a negative-working electrostatic liquid developer for electrostatic imaging comprising (A) dispersing at an elevated temperature in a vessel a thermoplastic resin, and a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes;

(B) cooling the dispersion, either (1) without stirring to form a gel or solid mass, followed by shredding the gel or solid mass and grinding by means of particulate media;

(2) with stirring to form a viscous mixture and grinding by means of particulate media; or (3) while grinding by means of particulate media to prevent the formation of a gel or solid mass;

(C) separating the dispersion of toner particles having an average by area particle size of less than 10 μm from the particulate media; and (D) adding to the dispersion during or subsequent to Step (A) a salt of an AB diblock copolymer charge director substantially soluble in component (A); wherein the B block is a polymer substantially soluble in component (A) having a number average molecular weight range of 2,000 to 50,000, and the A block is a trialkyl amino polymer having a number average molecular weight range of 200 to 10,000; wherein the number average degree of polymerization (DP) ratio of the B block to the A block being in the range of 10:2 to 100:20; and wherein the salt is formed by neutralizing the AB diblock copolymer with an acid.

DETAILED DESCRIPTION OF THE INVENTION

Throughout the specification the below-listed terms have the following meanings:

In the claims appended hereto, "consisting essentially of" means the composition of the electrostatic liquid developer does not exclude unspecified components which do not prevent the advantages of the developer from being realized. For example, in addition to the primary components, there can be present additional components, such as a colorant, fine particle size oxides, adjuvants, e.g., polyhydroxy compound, aminoalcohol, polybutylene succinimide, aromatic hydrocarbon, metallic soap, etc.

Conductivity is the conductivity of the developer measured in picomhos (pmho)/cm at 5 hertz and 5 volts.

Number average degree of polymerization (DP) means the average number of monomeric units per polymer chain. It is related to the number average molecular weight ($M_n$) by the formula $M_n = M_o \times DP$, where $M_o$ is the molecular weight of the monomer.

DISPERSANT NONPOLAR LIQUID

The dispersant nonpolar liquids (A) are, preferably, branched-chain aliphatic hydrocarbons. Suitable dispersant nonpolar liquids are disclosed the aforementioned U.S. Pat. No. 5,035,972, the disclosure of which is incorporated by reference. Some useful dispersant nonpolar liquids include Isopar®-G, Isopar®-H, Isopar®-K, Isopar®-L, Isopar®-M and Isopar®-V, Norpar®12, Norpar®13 and Norpar®15, available from Exxon Corporation. They have an electrical volume resistivity in excess of $10^9$ ohm centimeters and a dielectric constant below 3.0. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the resin, including components dispersed therein, and any pigment component present.

THERMOPLASTIC RESIN

Useful thermoplastic resins or polymers are disclosed in the aforementioned U.S. Pat. No. 5,035,972, the disclosure of which is incorporated by reference. Preferred copolymers are the copolymer of ethylene and an $\alpha,\beta$-ethylenically unsaturated acid of either acrylic acid or methacrylic acid. The synthesis of copolymers of this type are described in U.S. Pat. No. 3,264,272, the disclosure of which is incorporated herein by reference.

For the purposes of preparing the preferred copolymers, the reaction of the acid containing copolymer with the ionizable metal compound, as described in U.S. Pat. No. 3,264,272, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid number is milligrams of potassium hydroxide required to neutralize 1 gram of polymer. The melt index (g/10 min) of 10 to 500 is determined by ASTM D 1238 Procedure A. Particularly preferred copolymers of this type have an acid number of 54 and a melt index of 100 and 500 determined at 190° C., respectively.

In addition, the resins have the following preferred characteristics:

1. Be able to disperse the colorant, e.g., pigment, metallic soap adjuvant, etc.
2. Be substantially insoluble in the dispersant liquid at temperatures below 40° C., so that the resin will not dissolve or solvate in storage.
3. Be able to solvate at temperatures above 50° C. By solvation, the resins will become swollen, gelatinous or softened.
4. Be able to be ground to form particles preferably between 0.1 μm and 5 μm, in diameter (as determined by Horiba CAPA-500 centrifugal particle analyzer; Horiba Instruments, Inc., Irvine, Calif.) or between 1 μm and 15 μm in diameter (as determined by Malvern 3600E particle size analyzer).
5. Be able to form a particle having an average by area size of less than 10 μm (determined by Horiba CAPA-500 centrifugal automatic particle analyzer); solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm, and about 30 μm average particle size (determined by Malvern 3600E).
6. Be able to fuse at temperatures in excess of 70° C.

SALT OF AB DIBLOCK COPOLYMER CHARGE DIRECTOR

The salt of the AB diblock copolymer is formed by neutralizing the AB diblock copolymer with an acid. The AB diblock copolymer comprises a B block which is a polymer that is substantially soluble in the dispersant nonpolar liquid and has a number average molecular weight in the range of about 2,000 to 50,000 and an A block which is a trialkyl amino polymer having a number average molecular weight in the range of about 200 to 10,000, the number average degree of polymerization ratio of the B block to the A block is in the range of 10:2 to 100:20, preferably 20:3 to 40:10. Useful AB diblock copolymers and the synthesis thereof are disclosed in U.S. Pat. No. 5,106,717, the disclosure of which is incorporated by reference.

Preferred AB block polymers include: poly-2-(N,N-dimethylamino)ethyl methacrylate/polyethylhexyl methacrylate; poly-2-(N,N-diethylamino)ethyl methacrylate/polylauryl methacrylate; poly-2-vinyl pyridine/polyethylhexyl acrylate; poly-4-vinyl pyridine/-polybutadiene and poly-2-(N,N-diethylamino)ethyl methacrylate/polyethylhexyl methacrylate. The poly-2-(N,N-dimethylamino)ethyl methacrylate/polyethylhexyl methacrylate and poly-2-(N,N-diethylamino)ethyl methacrylate/polyethylhexyl methacrylate diblock copolymers have a number average degree of polymerization ratio of the B block to the A block of 30:8.

The optimum AB diblock copolymer structure is dependent on the electrostatic liquid developer. To optimize the AB diblock structure the size of the A and B polymer blocks, as well as the ratio between A and B can be changed.

Examples of acids useful for neutralization of the AB diblock copolymer include: mineral acids such as hydrochloric acid, sulfuric acid, and phosphoric acid; organic acids such as p-toluene sulfonic acid, benzoic acid, nitrobenzoic acid, chlorobenzoic acid, toluic acid, phosphonic acids, etc.

The use of the acid for neutralization rather than use of a quaternization agent gives some increased latitude in the choice of counterion in the charge director salt. The counterion will influence the effectiveness of the AB block copolymer as a charge director.

The salt of the AB diblock copolymer is present in 0.1 to 10,000 milligrams per gram of developer solids, preferably 1 to 1000 milligrams per gram of developer solids.

COLORANT

As indicated above, additional components that can be present in the electrostatic liquid developer are colorants, such as pigments or dyes and combinations thereof, which are preferably present to render the latent image visible, though this need not be done in some applications. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Suitable pigments are disclosed in U.S. Pat. No. 5,035,972.

Other ingredients may be added to the electrostatic liquid developer, such as fine particle size oxides, e.g., silica, alumina, titania, etc.; preferably in the order of 0.5 μm or less can be dispersed into the liquefied resin. These oxides can be used alone or in combination with the colorant. Metal particles can also be added.

OTHER ADDITIVES

Another additional component of the electrostatic liquid developer is an adjuvant which can be taken from the group of polyhydroxy compound which contains at least 2 hydroxy groups, aminoalcohol, polybutylene succinimide, metallic soap and aromatic hydrocarbon having a Kauri-butanol value of greater than 30. The adjuvants are generally used in an amount of 1 to 1000 mg/g, preferably 1 to 200 mg/g developer solids. Examples of the various above-described adjuvants are disclosed in U.S. Pat. No. 5,035,972.

The particles in the electrostatic liquid developer have an average by area particle size of less than 10 μm, preferably the average by area particle size is less than 5 μm as measured by the Horiba instrument described above. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

DEVELOPER PREPARATION

The electrostatic liquid developer can be prepared by a variety of processes. For example, suitable mixing or blending vessels, e.g., attritor, heated ball mill, heated vibratory mill such as a Sweco Mill manufactured by Sweco Co., Los Angeles, Calif., equipped with particulate media, for dispersing and grinding, Ross double planetary mixer manufactured by Charles Ross and Son, Hauppauge, N.Y., etc., or a two roll heated mill (no particulate media necessary), are used to disperse the thermoplastic resin in the dispersant nonpolar liquid. Generally the resin, dispersant nonpolar liquid and optional colorant are placed in the vessel prior to starting the dispersing step. Optionally the colorant can be added after homogenizing the resin and the dispersant nonpolar liquid. Polar liquid can also be present in the vessel, e.g., up to 100% based on the weight of total developer liquid.

The dispersing step is generally accomplished at an elevated temperature, i.e., a temperature sufficient to plasticize and liquefy the resin but below that at which the components present will degrade and/or decompose. A preferred temperature range is 80° to 120° C. Other temperatures outside this range may be suitable, however, depending on the particular ingredients used.

The presence of the irregularly moving particulate media in the vessel is preferred to prepare the dispersion of toner particles. Other stirring means can be used to prepare dispersed toner particles of proper size, configuration and morphology. Useful particulate media are particulate materials, e.g., spherical, cylindrical, etc. taken from the class consisting of stainless steel, carbon steel, alumina, ceramic, zirconia, silica, and sillimanite. Carbon steel particulate media is particularly useful when colorants other than black are used. A typical diameter range for the particulate media is in the range of 0.04 to 0.5 inch (1–13 mm).

After dispersing the ingredients in the vessel, with or without a polar liquid present until the desired dispersion is achieved (typically 1 hour with the mixture being fluid) the dispersion is cooled, e.g., in the range of 0° C. to 50° C. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding, e.g., by means of particulate media with or without the presence of additional liquid; or with stirring to form a viscous mixture and grinding by means of particulate media with or without the presence of additional liquid. Additional liquid may be added at any step during the preparation of the liquid electrostatic toners to facilitate grinding or to dilute the toner to the appropriate % solids needed for toning. Additional liquid means dispersant nonpolar liquid, polar liquid or combinations thereof.

Cooling is accomplished by any means known to those skilled in the art. The resin precipitates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time.

Another instrument for measuring average particles sizes is a Malvern 3600E Particle Sizer manufactured by Malvern, Southborough, Mass. which uses laser diffraction light scattering of stirred samples to determine average particle sizes. Since these two instrument use different techniques to measure average particle size the readings differ. The following correlation of the average size of toner particles in micrometers (μm) for the two instruments is:

| Value Determined By Malvern 3600E Particle Sizer | Expected Range For Horiba CAPA-500 |
|---|---|
| 30 | 9.9 ± 3.4 |
| 20 | 6.4 ± 1.9 |
| 15 | 4.6 ± 1.3 |
| 10 | 2.8 ± 0.8 |
| 5 | 1.0 ± 0.5 |
| 3 | 0.2 ± 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the particle size values are as measured using the Horiba instrument.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant nonpolar liquid as described previously above. The dilution is normally conducted to reduce the concentration of toner particles to between 0.1 to 15 percent by weight, preferably 0.3 to 3.0, and more preferably 0.5 to 2 weight percent with respect to the dispersant nonpolar liquid.

One or more AB diblock copolymer charge director compounds (C), which have been neutralized to for the salt thereof as set out above, can be added to impart a negative charge to the liquid electrostatic developer. The addition may occur at any time during the process preferably at the end of the process, e.g., after the particulate media, if used, are removed and the concentration of toner particles is accomplished. If a diluting dispersant nonpolar liquid is also added, the AB diblock copolymer salt charge director compound can be added prior to, concurrently with, or subsequent thereto. Adjuvants of a type described above can be added prior to or subsequent to the developer being charged.

INDUSTRIAL APPLICABILITY

The AB diblock copolymer salt charge directors of this invention are capable of charging electrostatic liquid developers negatively. The synthetic AB diblock copolymers are advantageous because their molecular weight, the amount of neutralization present, and the ratio of the neutralized block to the carrier liquid soluble block can be reproducibly controlled, which allows for superior batch to batch reproducibility of charge directors whose structures are selected for optimum developer performance. The AB diblock copolymers salts are prepared with high purity and very low toxicity. The electrostatic liquid developers demonstrate good image quality, resolution, solid area coverage, and toning of fine details, evenness of toning, and reduced squash independent of the pigment present. The developers of this invention are useful in copying, e.g., making office copies of black and white as well as various colors; or color proofing, e.g., a reproduction of an image using the standard colors: yellow, cyan, magenta together with black as desired. In copying and proofing the liquid developer is applied to a latent electrostatic image. Other uses envisioned for the electrostatic liquid developers include: digital color proofing, lithographic printing plates, and resists.

EXAMPLES

The following controls and examples wherein the parts and percentages are by weight illustrate, but do not limit, the invention. In the examples, the melt indices were determined by ASTM D1238, Procedure A, the average particle size by a Malvern 3600E Particle Sizer (Malvern, Southborough, Mass.), the conductivity was measured in picomhos/cm (pmhos) at 5 hertz and 5 volts, and the density was measured using a McBeth densitometer model RD918. The resolution is expressed in the examples as line pairs/mm (lp/mm).

Image quality was determined with a Savin 870 copier with the development voltage set at 300 volts and the transfer corotron at 7 kV.

The AB diblock copolymers used in the controls and examples were prepared as follows:

Preparation 1

A reaction vessel was charged with 353.983 lb toluene, 8.558 lb 1-ethoxy-1-trimethysiloxy-2-methypropene ("initiator"), and 0.427 lb 0.33M tetrabutylammonium-3-chlorobenzoate in acetonitrile/THF ("catalyst"). Two feeds were begun simultaneously; 0.427 lb catalyst in 1.471 lb THF was added over 120 minutes, and 291.948 lb 2-ethylhexyl methacrylate (EHMA) was added over 60 minutes. Reaction of EHMA was followed by FTIR. After 95% EHMA had reacted, 61.947 lb of 2-(N,N-dimethylamino) ethyl methacrylate (DMAEMA) was added. After reaction of all DMAEMA monomer, 7.876 lb of methanol was added to quench. To quaternize the amine groups, 73.363 lb of p-methyl-toluene sulfonate (MeOTs) were added to the above solution.

Preparation 2

A random copolymer of EHMA and DMAEMA was prepared as in U.S. Pat. No. 5,035,972, column 12, lines 15–22. The polymer was not quaternized.

To 16.54 grams of a 60.44% solids solution of polymer was added 0.611 ml concentrated sulfuric acid to neutralize. The solution was then diluted to 10% solids in Isopar ®-L.

Preparation 3

A reaction vessel was charged with 4034 g toluene, 6.0579 g mesitylene, 96.9 g 1-ethoxy-1-trimethysiloxy-2-methypropene ("initiator"), and 2.8 ml of 0.33M tetrabutylammonium-3-chlorobenzoate in acetonitrile/THF ("catalyst"). Two feeds were begun simultaneously; 2.8 ml of catalyst in 6 ml THF was added over 240 minutes and 3300.6 g 2-ethylhexyl methacrylate (EHMA) was added over 30 minutes. Reaction of EHMA was followed by high pressure liquid chromatography. After all EHMA had reacted, 712.6 g of 2-(N,N-dimethylamino) ethyl methacrylate (DMAEMA) was added over 20 minutes. After all the DMAEM monomer had reacted 89 g of methanol was added to quench.

To 101.8 grams of a 49.1% solids solution of polymer was added 3 ml concentrated sulfuric acid to neutralize. The solution was then diluted to 10% solids in Isopar ®-L.

Preparation 4

A reaction vessel was charged with 104.54 g toluene, 2.6 g mesitylene, 2.09 g 1-ethoxy-1-trimethysiloxy-2-methypropene ("initiator"), and 0.4 ml of 0.33M tetrabutylammonium-3-chlorobenzoate in acetonitrile/THF ("catalyst"). 0.4 ml of catalyst in 4 g THF and 94.45 g 2-ethylhexyl methacrylate (EHMA) was added over 175 minutes. Reaction of EHMA was followed by high pressure liquid chromatography. After all EHMA had reacted, 5.69 g of 2-(N,N-dimethylamino)ethyl methacrylate (DMAEMA) was added.

After all the DMAEM monomer had reacted 3.36 g of methanol was added to quench.

To 16.12 grams of a 62.05% solids solution of polymer was added 0.3 ml concentrated hydrochloric acid to neutralize. The solution was then diluted to 10% solids in Isopar ®-L.

Preparation 5

An EHMA//DMAEMA block copolymer was prepared as in Preparation 3. To 101.8 grams of a 49.1% solids solution of polymer was added 4.5 ml concentrated hydrochloric acid to neutralize. The solution was then diluted to 10% solids in Isopar ®-L.

Preparation 6

An EHMA//DMAEMA block copolymer was prepared as in Preparation 3. To 101.8 grams of a 49.1% solids solution of polymer was added 3.67 ml concentrated phosphoric acid to neutralize. The solution was then diluted to 10% solids in Isopar ®-L.

Control 1

In a Union Process 1S attritor, Union Process Company, Akron, Ohio, were placed the following ingredients:

| INGREDIENT | AMOUNT (g) |
|---|---|
| Terpolymer of methyl methacrylate (67.3%), methacrylic acid (3.1%), and ethylhexyl acrylate (29.6%). Weight average molecular weight is 172,000, acid no. 13 | 297.5 |
| R6700 magenta pigment, BASF, Holland, MI | 52.5 |
| Isopar ®-L, non-polar liquid having Kauri-butanol value of 27 (Exxon Corp.) | 946 |

The ingredients were heated to a temperature in the range of 90° C. to 110° C. and milled with 0.1875 inch (4.76 mm) diameter stainless steel balls for 1 hour. The attritor was cooled to 42° C. to 50° C. while milling was continued. 1037 grams of Isopar ®-L was added. Milling was continued for five and a half hours to obtain toner particles with an average size of 5.8 μm by area as measured on the Malvern Particle Sizer. The particulate media were removed and the developer was diluted to 1% solids with additional Isopar ®-L. To this dispersion was added 100 mg of Basic Barium Petronate ® (Witco Corp.) per gram of toner solids. Images were run on a Savin 870 copier. Results are shown in Table 1.

Control 2

The developer was prepared as in Control 1, except that instead of Basic Barium Petronate ® charge director, the quaternized AB block copolymer described as Preparation 1 was added to the developer suspension at 30 mg/g of toner solids. The developer was imaged on a Savin 870 copier and results are given in Table 1.

Control 3

The developer was prepared as in Control 1, except that instead of Basic Barium Petronate ®, the random copolymer described as Preparation 2 was added to the developer suspension at 30 mg/g of toner solids. The developer was imaged on a Savin 870 copier and results are given in Table 1.

EXAMPLE 1

The developer was prepared as in Control 1, except that instead of Basic Barium Petronate ®, the acidified AB block copolymer described as Preparation 3 was added to the developer suspension at 30 mg/g of toner solids. The developer was imaged on a Savin 870 copier and results are given in Table 1.

EXAMPLE 2

The developer was prepared as in Control 1, except that instead of Basic Barium Petronate ®, the acidified AB block copolymer described as Preparation 4 was added to the developer suspension at 30 mg/g of toner solids. The developer was imaged on a Savin 870 copier and results are given in Table 1.

TABLE 1

| Sample | Density | Resolution (lines/mm) | % Transfer Efficiency | % Plate Neg. | % Plate Pos. |
|---|---|---|---|---|---|
| C1 | 0.06 | — | 45 | 0–5 | 95–100 |
| C2 | 0.66 | 5.0 | 55 | 100 | 0 |
| C3 | 1.40 | — | 15 | 99 | 0 |
| E1 | 1.35 | 5–5.6 | 45 | 99 | 0 |
| E2 | 1.68 | 5–5.6 | 45 | 100 | 0 |

| Sample | Comments |
|---|---|
| C1 | positive developer |
| C2 | non-uniform solids |
| C3 | very poor transfer to paper |
| E1 | good solids, sharp edges |
| E2 | good solids, some smear |

Control 4

In a Union Process 1S attritor, Union Process Company, Akron, Ohio, were placed the following ingredients:

| INGREDIENT | AMOUNT (g) |
|---|---|
| Copolymer of ethylene (91%) and methacrylic acid (9%): melt index 500, acid no. 54 | 283.5 |
| Mogul ®L carbon black, Cabot Corp. Boston, MA | 66.5 |
| Isopar ®-L, non-polar liquid having Kauri-butanol value of 27 (Exxon Corp.) | 946 |

The ingredients were heated to a temperature in the range of 90° C. to 110° C. and milled with 0.1875 inch (4.76 mm) diameter stainless steel balls for 40 minutes. The attritor was cooled to 30° C. while milling was continued. 1037 grams of Isopar ®-L were added. Milling continued for twelve hours and 15 minutes to obtain toner particles with an average size of 7.0 μm by area as measured on the Malvern Particle Sizer. The particulate media were removed and the developer was diluted to 1% solids with additional Isopar ®-L. To this dispersion was added 30 mg of Basic Barium Petronate ® per gram of toner solids. Images were run on a Savin 870 copier. Results are shown in Table 2.

Control 5

The developer was prepared as in Control 4, except that instead of Basic Barium Petronate ®, the quaternized AB block copolymer described as Preparation 1 was added to the developer suspension at 30 mg/g of toner solids. The developer was imaged on a Savin 870 copier and results are given in Table 2.

Control 6

The developer was prepared as in Control 4, except that instead of Basic Barium Petronate®, the random copolymer described as Preparation 2 was added to the developer suspension at 30 mg/g of toner solids. The developer was imaged on a Savin 870 copier and results are given in Table 2.

EXAMPLE 3

The developer was prepared as in Control 4, except that instead of Basic Barium Petronate®, the acidified AB block copolymer described as Preparation 3 was added to the developer suspension at 30 mg/g of toner solids. The developer was imaged on a Savin 870 copier and results are given in Table 2.

EXAMPLE 4

The developer was prepared as in Control 4, except that instead of Basic Barium Petronate®, the acidified AB block copolymer described as Preparation 5 was added to the developer suspension at 30 mg/g of toner solids. The developer was imaged on a Savin 870 copier and results are given in Table 2.

EXAMPLE 5

The developer was prepared as in Control 4, except that instead of Basic Barium Petronate®, the acidified AB block copolymer described as Preparation 6 was added to the developer suspension at 30 mg/g of toner solids. The developer was imaged on a Savin 870 copier and results are given in Table 2.

TABLE 2

| Sample | Density | Resolution (lines/mm) | % Transfer Efficiency | % Plate Neg. | % Plate Pos. |
|---|---|---|---|---|---|
| C4 | 2.35 | 3.2 | 80–85% | 99–95 | 0–5 |
| C5 | 0.54 | 4.0 | 55 | 60–70 | 20 |
| C6 | 1.66 | 7.1–8.0 | 100 | 95–100 | 0–5 |
| E3 | 2.25 | 3.6–4.0 | 80 | 95–100 | 0–5 |
| E4 | 2.58 | 5.6 | 80–85 | 99 | 0 |
| E5 | 2.55 | 4.0 | 70–75 | 99 | 0 |

| Sample | Comments |
|---|---|
| C4 | significant background |
| C5 | poor transfer to paper |
| C6 | non-uniform solids |
| E3 | background development, good solids |
| E4 | no background, good solids |
| E5 | low background, good solids |

I claim:

1. An improved negative electrostatic liquid developer consisting essentially of (A) a nonpolar liquid having a Kauri-butanol value of less than 30, (B) thermoplastic resin particles having an average by area particle size of less than 10 μm, and (C) a salt of an AB diblock copolymer charge director substantially soluble in component (A), wherein the B block is a polymer substantially soluble in component (A) having a number average molecular weight range of 2,000 to 50,000, and the A block is a trialkyl amino polymer having a number average molecular weight range of 200 to 10,000, the number average degree of polymerization (DP) ratio of the B block to the A block being in the range of 10:2 to 100:20, and wherein the salt is formed by neutralizing the AB diblock copolymer with an acid.

2. The electrostatic liquid developer according to claim 1 wherein the A block of the AB diblock copolymer is a polymer prepared from at least one monomer selected from the group consisting of:

(1) $CH_2{=}CCH_3CO_2R$, (2) $CH_2{=}CHCO_2R$; wherein R is alkyl of 1 to 20 carbon atoms where the terminal end of R is of the general formula $N(R^1)_3$, where N is nitrogen, $R^1$ is alkyl of 1 to 200 carbon atoms, aryl of 6 to 30 carbon atoms, alkylaryl of 7 to 200 carbon atoms, and (3) 2-, 3-, or 4-vinyl pyridine wherein the ring carbon atoms not substituted by the vinyl group may be substituted with $R^1$ and the pyridine nitrogen atom is substituted with $R^1$ wherein $R^1$ is defined above.

3. The electrostatic liquid developer according to claim 1 wherein the B block of the AB diblock copolymer is a polymer prepared from at least one monomer selected from the group consisting of butadiene, isoprene and compounds of the general formulas: $CH_2{=}CCH_3CO_2R^2$ and $CH_2{=}CHCO_2R^2$ wherein $R^2$ is alkyl of 8 to 30 carbon atoms.

4. The electrostatic liquid developer according to claim 1 wherein the AB diblock copolymer is selected from the group consisting of poly-2-(N,N-dimethylamino)ethyl methacrylate//polyethylhexyl methacrylate; poly-2-(N,N-diethylamino)ethyl methacrylate//polylauryl methacrylate; poly-2-vinyl pyridine//polyethylhexyl acrylate; poly-4-vinyl pyridine//-polybutadiene and poly-2-(N,N-diethylamino)ethyl methacrylate//polyethylhexyl methacrylate.

5. The electrostatic liquid developer according to claim 1 wherein the AB diblock copolymer is poly-2-(N,N-dimethylamino)ethyl methacrylate//polyethylhexyl methacrylate wherein the number average degree of polymerization ratio of the B block to the A block is 30:8.

6. The electrostatic liquid developer according to claim 1 wherein the AB diblock copolymer is poly-2-(N,N-diethylamino)ethyl methacrylate//polyethylhexyl methacrylate wherein the number average degree of polymerization ratio of the B block to A block is 30:8.

7. The electrostatic liquid developer of claim 1 wherein the acid is selected from the group consisting of mineral acids and organic acids.

8. The electrostatic liquid developer according to claim 1 wherein component (A) is present in 85 to 99.9% by weight, based on the total weight of the liquid developer, the total weight of solids is 0.1 to 15% by weight, and component (C) is present in 0.1 to 10,000 milligrams per gram of developer solids.

9. The electrostatic liquid developer according to claim 1 containing up to about 60% by weight of a colorant based on the total weight of developer solids.

10. The electrostatic liquid developer according to claim 9 wherein the colorant is a pigment.

11. The electrostatic liquid developer according to claim 1, further including an adjuvant selected from the group consisting of polyhydroxy compound, aminoalcohol, polybutylene succinimide, metallic soap, and an aromatic hydrocarbon.

12. The electrostatic liquid developer according to claim 1 wherein the thermoplastic resin is a copolymer of ethylene and an α,β-ethylenically unsaturated acid selected from the group consisting of acrylic acid and methacrylic acid.

13. The electrostatic liquid developer according to claim 1 wherein the particles have an average by area particle size of less than 5 μm.

14. A process for preparing a negative-working electrostatic liquid developer for electrostatic imaging comprising (A) dispersing at an elevated temperature in a vessel a thermoplastic resin and a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (B) cooling the dispersion, either (1) without stirring to form a gel or solid mass, followed by shredding the gel or solid mass and grinding by means of particulate media;

(2) with stirring to form a viscous mixture and grinding by means of particulate media; or (3) while grinding by means of particulate media to prevent the formation of a gel or solid mass;

(C) separating the dispersion of toner particles having an average by area particle size of less than 10 μm from the particulate media, and (D) adding to the dispersion during or subsequent to Step (A) a salt of an AB diblock copolymer charge director substantially soluble in the nonpolar dispersant liquid, wherein the B block is a polymer substantially soluble in the nonpolar dispersant liquid having a number average molecular weight range of 2,000 to 50,000, and the A block is a trialkyl amino polymer having a number average molecular weight range of 200 to 10,000, the number average degree of polymerization (DP) ratio of the B block to the A block being in the range of 10:2 to 100:20, and wherein the salt is formed by neutralizing the AB diblock copolymer with an acid.

15. The process according to claim 14 wherein there is present in the vessel up to 100% by weight of a polar liquid having a Kauri-butanol value of at least 30, the percentage based on the total weight of the developer liquid.

16. The process according to claim 14 wherein cooling the dispersion is accomplished while grinding by means of particulate media to prevent the formation of a gel or solid mass with or without the presence of additional liquid.

* * * * *